United States Patent [19]

Miller et al.

[11] 4,141,382

[45] Feb. 27, 1979

[54] CONTROLS FOR ACTUATING A DIRECTION CONTROL VALVE TO AND RELEASING IT FROM A FLOAT-EFFECTING CONDITION

[75] Inventors: James A. Miller; William L. Snyder, both of Cedar Falls, Iowa

[73] Assignee: Deere & Company, Moline, Ill.

[21] Appl. No.: 848,264

[22] Filed: Nov. 3, 1977

[51] Int. Cl.[2] ..... F15B 13/043; F15B 13/08

[52] U.S. Cl. ..... 137/596.15; 91/464; 137/596.16

[58] Field of Search ..... 91/464; 137/596.15, 137/596.16, 637.1

[56] References Cited

U.S. PATENT DOCUMENTS

| | | | |
|---|---|---|---|
| 3,924,656 | 12/1975 | Hanser et al. | 137/596.16 X |
| 4,057,701 | 11/1977 | Sisk et al. | 200/157 |

*Primary Examiner*—Gerald A. Michalsky

[57] ABSTRACT

A direction control valve for controlling a reversible hydraulic actuator includes a valve body in which a pair of valve stems and a pair of float control pistons, respectively axially aligned with the valve stems, are reciprocally mounted. To establish a float condition in the actuator, the pair of valve stems are simultaneously shifted to respective active positions by engagement of the pair of float-control pistons to which pressure fluid is routed upon selective energization of a solenoid-operated valve by manually closing a first normally open switch. A second normally open switch is connected in parallel with the first switch and is closed by a switch-control piston mounted in the valve body between and in fluid communication with the float-control pistons and shiftable concurrent therewith whereby the manually operable switch may be released without effecting de-energization of the solenoid-operated valve. A control rod is rockably mounted in the valve body for selective movement to opposite sides of a neutral position for respectively initiating independent shifting of the pair of valve stems to their active positions for respectively effecting extend and retract conditions in the actuator. A cam is fixed to the control rod and is operable, when the control valve is in its float-effecting condition and the control rod is moved from its neutral position, to move the switch-control piston to release the second switch and de-energize the solenoid-operated valve whereby the control valve is released from its float effecting condition.

6 Claims, 4 Drawing Figures

CONTROLS FOR ACTUATING A DIRECTION CONTROL VALVE TO AND RELEASING IT FROM A FLOAT-EFFECTING CONDITION

BACKGROUND OF THE INVENTION

The present invention relates to a control system for direction control valve and, more particularly, relates to a control system, which is specifically adapted for controlling valves like the one disclosed in U.S. Pat. No. 3,924,656 issued to Hanser et al. on Dec. 9, 1975, this valve, in turn, being particularly useful in controlling reversible hydraulic actuators used for effecting vertical adjustment of a motor grader blade in a manner similar to that disclosed in co-pending U.S. patent application Ser. No. 712,606 filed by Sisk et al. on Aug. 9, 1976 now U.S. Pat. No. 4,057,701.

In the control system disclosed in the aforementioned patent application, the operator must hold a normally open, manually operable switch in a closed condition in order to maintain a float-effecting condition in the direction control valve. This holding thus occupies the use of at least one hand of the operator during anytime the blade is operated in a float mode and such is not desirable in view of the many other functions which require the use of the operator's hands.

SUMMARY OF THE INVENTION

According to the present invention there is provided a novel control for establishing a float-effecting condition in a direction control valve.

An object of the invention is to provide a control which requires only momentary use of an operator's hand for establishing a float-effecting condition in a direction control valve for controlling a reversible hydraulic actuator.

A more specific object is to provide a control, as set forth in the preceding object, which includes a normally open manually-operated switch selectively closeable for energizing the solenoid of a solenoid-operated valve so as to shift the latter to route pressurized control fluid to the direction control valve, and a normally open pilot-operated switch connected in parallel with manually-operated switch and having a pressure responsive actuator associated therewith for closing the same in response to the pressurized control fluid whereby the manually-operated switch may then be released without effecting de-energization of the solenoid.

Yet another object is to provide a control, as set forth in the above objects, which includes means for manually effecting the return of the pilot-operated switch to its open position.

These and other objects will become apparent from a reading of the ensuing description together with the appended drawings.

DESCRIPTION OF THE PREFERRED EMBODIMENT

Figure 1:
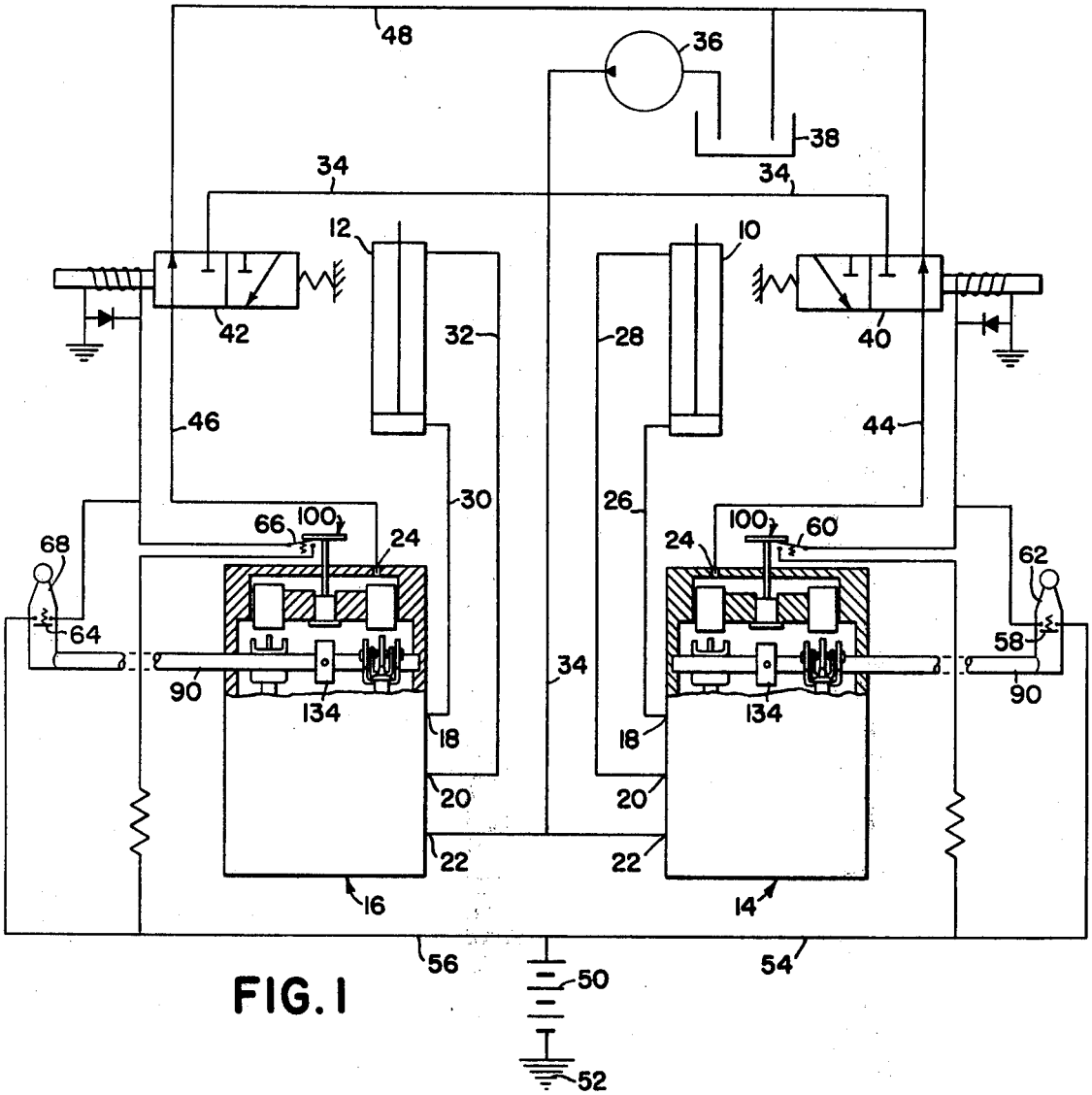
FIG. 1 is a schematic of a control system embodying the present invention.

Referring now to FIG. 1, therein is shown a system for controlling the operation of right and left hydraulic actuators 10 and 12, the system being particularly suited for controlling the operation of a pair of hydraulic lift actuators for adjusting the vertical displacement of the opposite ends of a motor grader blade in a manner generally similar to that disclosed in the aforementioned application Ser. No. 712,606 now U.S. Pat. No. 4,057,701.

Specifically, the system includes identical right and left direction control valves 14 and 16, respectively, which are key components of the present invention and, except for some important additions described hereinbelow, are identical to the valve disclosed in the aforementioned U.S. Pat. No. 3,924,656.

Each of the control valves 14 and 16 includes first and second control ports 18 and 20, a fluid pressure inlet port 22 and a pilot-pressure port 24. The ports 18 and 20 of the valve 14 are respectively coupled to opposite work ports of the actuator 10 by means of pressure-return lines 26 and 28. Similarly, the ports 18 and 20 of the valve 16 are coupled to opposite work ports of the actuator 12 by means of pressure-return lines 30 and 32. The inlet port 22 of each of the valves 14 and 16 are coupled, by means of a branched supply line 34, to the outlet of a pump 36 having its inlet coupled to a sump 38. The pilot-pressure ports 24 respectively of the valves 14 and 16 are connected to respective first sides of right and left solenoid-operated valves 40 and 42, respectively, by means of lines 44 and 46, while respective second sides of the valves 40 and 42 are connected to the pump 36, via the branched supply line 34 and to the sump 38, via a return line 48. The valves 40 and 42 are two-position valves which are normally in a deactivated first position, as illustrated, wherein they connect the respective pilot-pressure ports 24 to the sump 38, the valves 40 and 42 being selectively energizeable, in a manner hereinbelow described, to effect their shifting to respective active positions wherein they connect the respective ports 24 of the valves 14 and 16 to the pump 36.

For supplying electrical current to the solenoid-operated valves 40 and 42, there is provided a source of electrical current, here shown schematically in the form of a battery 50 connected to ground at 52 and to a power line having right and left branches 54 and 56, respectively. The right power line branch 54 is connected to the right solenoid-operated valve 40 and includes first and second normally open switches 58 and 60 connected in parallel with each other and in series between the battery 50 and valve 40. The switch 58 is mounted on a control lever 62 for being selectively manually closed in a manner which may be similar to that disclosed in the aforementioned application Ser. No. 712,606 now U.S. Pat. No. 4,057,701. The switch 60 is mounted on the control valve 14 for being selectively closed by a pilot-operated actuator in a manner hereinafter described.

Similarly, the left power line branch 56 is connected to the left solenoid-operated valve 42 and includes first and second normally open switches 64 and 66 connected in parallel with each other and in series between the battery 50 and valve 42. The switch 64 is mounted on a control lever 68 for selective manual actuation while the switch 66 is mounted on the control valve 16 for actuation by a pilot-operator actuator.

Figure 3:
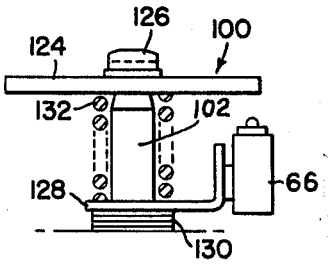
FIG. 3 is a side elevational view showing a portion of the actuator for, and the mounting of, the pilot-operated switch.
Figure 4:
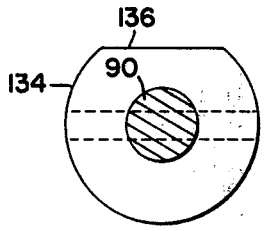
FIG. 4 is an enlarged sectional view taken along the line 4—4 of FIG. 2 and showing the control rod and switch actuator return cam.
Figure 2:
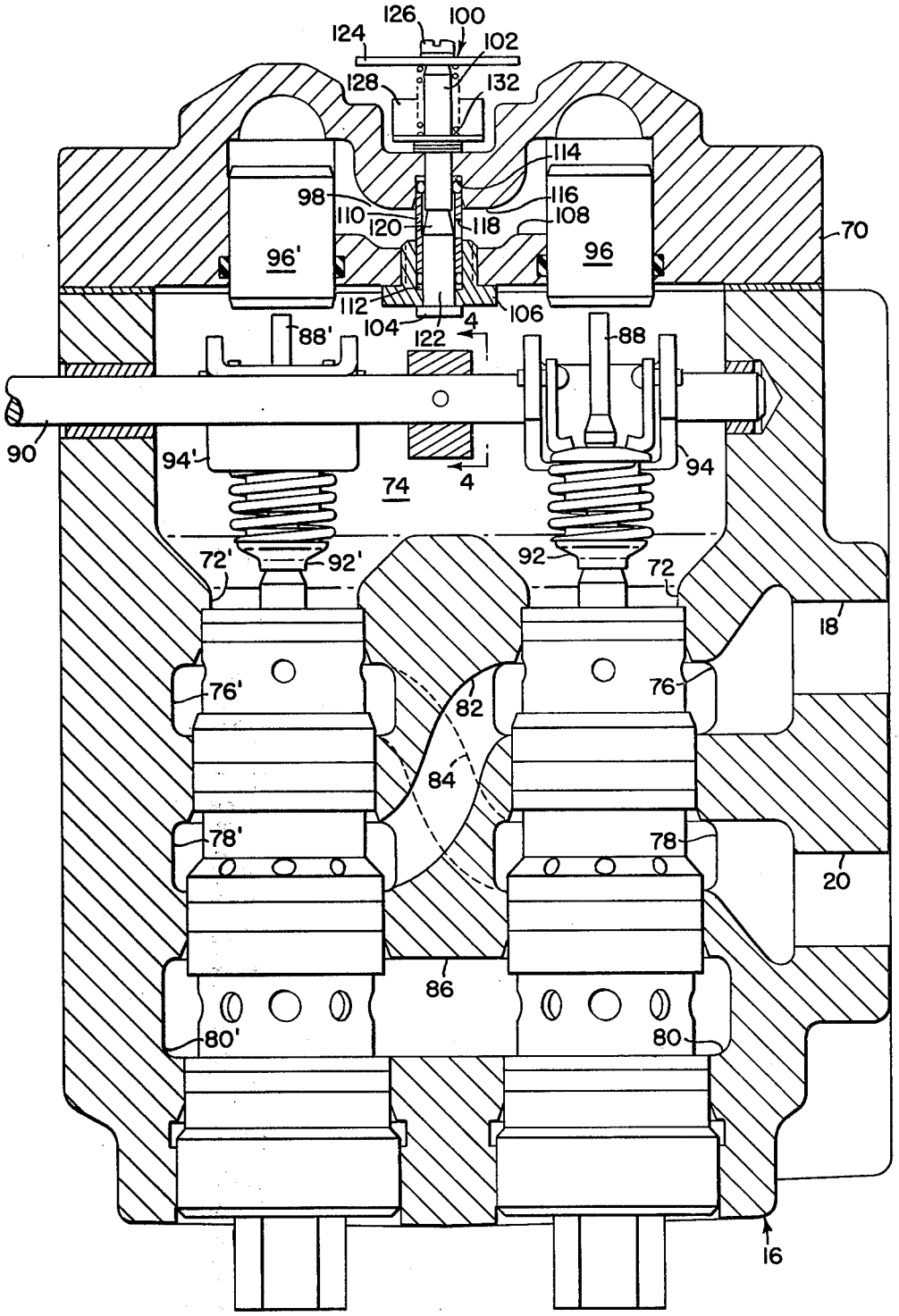
FIG. 2 is a sectional view taken longitudinally through a direction control valve of a type with which the present invention is particularly adapted for use.

Referring now to FIGS. 2–4, the direction control valves 14 and 16, as represented here by the left control valve 16, will be described in detail with the reference numerals applied here being also applied to those corresponding parts of each of the valves that are shown schematically in FIG. 1. Thus, each of the control valves 14 and 16 includes a valve lave body or housing 70 having identical right and left vertical sleeve-lined bores 72 and 72' provided therein and having upper ends opening into a cavity defining a fluid reservoir 74. Upper, intermediate and lower annular recesses 76, 78, and 80 are respectively defined by the right bore 72 while a corresponding set of bores 76', 78' and 80' are respectively defined by the right bore 72'. The upper and intermediate recesses 76 and 78 of the right bore are respectively connected to the intermediate and upper recesses 78' and 76' and the left bore by passages 82 and 84 while the lower recesses 80 and 80' are connected to each other by a passage 86. The ports 18, 20 and 22 of each of the valves 14 and 16 are respectively connected to the recesses 76, 78, and 80.

Respectively reciprocably mounted in the right and left bores 72 and 72' of each of the valves 14 and 16 are right and left valve stems 88 and 88' which carry valve elements (not shown but fully described in U.S. Pat. No. 3,924,656) arranged such that when the stem 88 and 88' of a respective valve are in respective neutral positions, as illustrated, flow to and from the control ports 18 and 20 is blocked to effect a lock condition in a respective actuator; when the right stem 88 is shifted downwardly, flow is established between the inlet port 22 and the control port 20 and between the control port 18 and reservoir 74 to effect an extend condition in a respective actuator; when the left stem 88' is shifted downwardly, flow is established between the inlet port 22 and control port 18 and between the control port 20 and the reservoir 74 to effect a retract condition in a respective actuator; and when both stems 88 and 88' are simultaneously shifted downwardly, the control ports 18 and 20 are both connected to the reservoir 74 to effect a float condition in a respective actuator.

A control rod 90 is rotatably mounted in the housing 70 of each of the control valves 14 and 16 and is disposed in the reservoir 74 in adjacent crosswise relationship to upper end portions of the valve stems 88 and 88'. Respectively mounted on the valve stem 88 and 88' are sleeve-like valve elements 92 and 92' which are respectively connected, as at 94 and 94', to the associated control rod 90 by lost-motion connections (not specifically shown) which are operative to effect downward shifting of the valve element 92 when the rod 90 is rotated one way and to effect downward shifting of the valve element 92' when the rod is rotated in the opposite way, the shifting of the valve elements 92 and 92' in turn respectively effecting, in a manner not shown, pilot operation of the valve stems 88 and 88' to their downward shifted positions. The control lever 68 is connected to the control rod 90 of the valve 16 and is swingable to opposite sides of a neutral position to effect selective movement of the control rod.

Reciprocally mounted in the housing 70 of each of the control valves 14 and 16 in axial alignment with and adjacent to the tops of the valve stems 88 and 88' are right and left float-control pistons 96 and 96'. The top ends of the pistons 96 and 96' are exposed to a pressure fluid chamber 98 to which the pilot fluid port 24 is connected. Thus, the chambers 98 of the right and left valves 14 and 16 are respectively connected to the sump 38 when the solenoid-operated valves 40 and 42 are in their respective deactivated first positions and are connected to the pump 36 when the valves 40 and 42 are in their respective energized active positions. Upon pressurization of the chamber 98, the pistons 88 and 88' are simultaneously pressure-shifted downwardly to effect downward shifting of the valve stems 88 and 88' and, consequently, the establishment of the float condition in the actuators 10 and 12.

Reciprocally mounted in the housings 70 of each of the valves 14 and 16 at a location between the pistons 96 and 96' and in fluid communication with the chamber 98 is a pressure-responsive, switch actuator 100. Specifically, the actuator 100 includes a rod-like piston 102 which extends through the top of the housing in traversing relationship to the chamber 98. The lower end of the piston 102 is defined by the enlarged head 104 which prevents upward movement of the piston through a bore located in a retaining member 106 threaded into a lower wall portion 108 of the chamber 98. Forming a cylinder 110 for the piston 102 is a tubular member having its lower end held in a counterbore recess 112 formed in the retaining member 106 and having its upper end held in a counterbore recess 114 formed in an upper wall portion 116 of the chamber 98. The cylinder 110 is provided with an opening 118 which establishes fluid communication between the chamber 98 and a frusto-conical surface 120 of the piston 102 which joins an enlarged diameter lower portion 122 of the piston 102 with the remainder of the latter. A circular switch-operating plate 124 is held on the upper end of the piston 102 by a screw 126 and received on the piston 102 below the plate 124 is a switch mounting bracket 128, the switch 60 being mounted on the bracket 128 associated with the valve 14 and the switch 66 being mounted on the bracket 128 associated with the valve 16. The spacing between the switch-operating plate 124 and the associated switch may be adjusted by means of shims such as are shown at 130 (FIG. 3). A coil compression spring 132 is received on the piston 102 between the plate 124 and the bracket 128 and acts to normally maintain the plate in a position spaced from the associated switch.

It will be appreciated then that upon a respective one of the chambers 98 becoming pressurized upon actuation of the associated one of the solenoid-operated valves 40 and 42, the associated piston 102 will shift downwardly to a switch actuating position where it closes the associated one of the switches 60 and 66. Mounted on the control rod 90 of each of the valves 14 and 16 is a generally cylindrical cam 134 having a flat surface 136 which is disposed such as to be engaged by the lower end of the piston 102 when the latter is in its downwardly shifted switch-actuating position and the control rod 90 is in a central neutral position. Upon rotation of the rod, in either direction from its neutral position, the cam will force the piston 102 upwardly against the pressure acting thereon to effect disengagement of the switch operating plate 124 from the associated switch and consequently effect the de-energization of the associated solenoid-operated valve.

The operation of the invention is as follows. If it is desired to effect a float condition in the right actuator 10, for example, the operator will momentarily close the switch 58 to energize the right solenoid-operated valve 40. As soon as the valve 40 is energized, it will shift to the right so as to connect the pump 36 to the chamber 98 of the right direction control valve 14. The float control pistons 96 and 96' will then be pressure-shifted downwardly such as to effect downward movement of the valve stems 88 and 88' which operates to connect both work ports of the actuator 10 to the reservoir 74 to thus establish the float condition in the actuator. Concurrently with the downward movement of the pistons 96 and 96', the pressure-responsive switch actuating piston 102 shifts downwardly into engagement with the flat surface 136 of the cam 134, and brings the plate 124 into engagement with the switch 60 to effect closing thereof. Accordingly, immediately after closing the switch 58, the operator may release it since an alternate path for electric current to pass to the valve 40 is established via the switch 60.

Should the operator desire to return the actuator 10 from its float to its hold condition, he needs only to momentarily rotate the control rod 90 from its neutral position by means of the lever 62, such rotation immediately disengaging the plate 124 from the switch 60. The switch 60 then opens to effect deenergization of the solenoid-operated valve 40 to thus permit the latter to return to its normal position wherein it connects the chamber 98 to the sump 38. Of course, should the operator desire the actuator 10 to extend or retract immediately after it is actuated from its float condition he needs only to hold the control rod 90 in the appropriate rotated position from its neutral position.

For the sake of brevity, the description of the operation of the left actuator 12 is dispensed with since it is similar to that of the right actuator, it further being noted however that the actuators 10 and 12 may be simultaneously actuated if desired.

We claim:

1. In a direction control valve and control system therefor wherein the direction control valve includes first and second independently shiftable elements respectively shiftable from neutral positions to actuated positions for effecting first and second flow directions through the valve, a manually-operated actuating member connected to the first element and movable between neutral and first positions for moving the first element between its neutral and actuated positions, pressure-responsive actuating means pressurizable and mounted for moving the second element from its neutral to its actuated position, a fluid circuit for selectively pressurizing the pressure-responsive actuating means including a pressure source, a sump and a solenoid-operated valve connected to the pressure-responsive actuating means, the pressure source and the sump and being movable between an unactuated and an actuated position respectively wherein it connects the pressure-responsive actuating means to the sump and to the source of pressure; and an electrical circuit for selectively energizing the solenoid-operated valve including an electrical current source, a normally open manually operated switch connected in series with and between the current source and the solenoid-operated valve, the improvement comprising: said circuit including a second normally open switch connected in series with and between the current source and the solenoid-operated valve and connected in parallel with the manually-operated switch; a pressure-responsive element mounted adjacent the second switch for movement thereagainst to effect closing of the latter when pressure is received by the last-named element; conduit means connecting the pressure-responsive element to the pressure-operated actuating means for causing the pressure-responsive element to move to effect closing of the second switch anytime the actuating means is pressurized; and motion transfer means connected to the manually-operated actuating member for effecting movement of the pressure responsive element away from the second switch to effect opening of the latter when the manually-operated actuating member is moved toward its first position, whereby, once the manually operated switch is closed to energize the solenoid-operated valve so as to effect pressurization of the pressure-operated actuating means and thus to effect the second flow direction through the direction control valve, the manually operated switch may be released and the second flow direction through the direction control valve will be maintained until the manually operated actuating member is moved to effect the first flow direction through the direction control valve.

2. In a direction control valve and control system therefor wherein the valve includes a valve body having first and second parallel arranged valve assemblies located therein, said valve assemblies being provided at respective first ends with a pair of valve elements, adapted for independent movement between neutral and actuated positions for respectively establishing first and second flow conditions through the valve, and with a pair of second valve elements adapted for simultaneous movement between neutral and actuated positions for establishing a third flow condition through the valve, a manually operable control rod rotatably mounted in the housing adjacent the first valve elements, means connecting the rod to the first valve elements such that rotation of the rod in a first direction from a neutral position thereof will effect shifting of the first valve element of the first valve assembly while rotation of the rod in a second direction from the neutral position thereof will effect shifting of the first valve element of the second valve assembly; first and second pistons respectively reciprocably mounted in the housing in alignment with and respectively adjacent the second valve elements of the first and second valve assemblies and being adapted for simultaneous engagement with the second valve elements to effect simultaneous shifting thereof; a fluid passage connecting the first and second pistons in parallel with each other and to a solenoid-operated valve; a pressure source and a sump connected to the solenoid-operated valve and the latter being shiftable between a de-energized position wherein it connects the pistons to the sump and an energized position wherein it connects the pistons to the pressure source, an electrical circuit for selectively energizing the solenoid-operated valve including a normally open manually-operated switch connected in series with and between an electrical current source and the solenoid-operated valve, the improvement comprising; a switch operating member means reciprocably mounted in the housing for movement between switch-release and switch-close positions; said member means including a surface connected in fluid communication with the fluid passage and configured such that fluid pressure in the passage will force the member means to its switch-close position; a second normally open switch mounted adjacent the member means for closing by the latter as the member means reaches its switch-close position; and motion transfer means mounted on the control rod in alignment with the member means for moving the latter from its switch-close to its switch-release position in response to rotation of the control rod in either direction from its neutral position.

3. The direction control valve and control system therefor defined in claim 2 wherein the member means includes a pin reciprocably mounted for movement crosswise to said control rod and said motion transfer means being defined by a cam member fixed to the control rod in a location for engaging one end of the pin to return the member means to its switch-release position.

4. The direction control valve and control system therefor defined in claim 3 wherein the pin has a second end, opposite from said one end, projecting exteriorly of the housing; said one end being provided with a shoulder; switch operating element slidably mounted on the pin; a biasing means acting between the housing and the switch-operating element and urging the switch operating member means toward its switch-release position; and the second switch being located exteriorly of the housing for closing contact by the switch-operating element.

5. The direction control valve and control system therefor defined in claim 4 wherein the switch is slidably mounted on the pin and said biasing means is a coil spring compressed between the switch and the switch operating element.

6. The direction control valve and control system therefor defined in claim 5 and including means mounted on the pin for adjusting the spatial relationship between the switch and the switch operating element as considered when the switch operating member means is in its switch-release position.

* * * * *